US008587395B2

(12) United States Patent
Bandy

(10) Patent No.: US 8,587,395 B2
(45) Date of Patent: Nov. 19, 2013

(54) ROTARY ENCODER SWITCH WITH PULL FUNCTION TACTILE FEEDBACK AND POSITIVE STOP

(75) Inventor: Gregory Seth Bandy, Roanoke, VA (US)

(73) Assignee: Exelis, Inc., McLean, VA (US)

( * ) Notice: Subject to any disclaimer, the term of this patent is extended or adjusted under 35 U.S.C. 154(b) by 0 days.

(21) Appl. No.: 13/438,404

(22) Filed: Apr. 3, 2012

(65) Prior Publication Data

US 2013/0257570 A1 Oct. 3, 2013

(51) Int. Cl.
*H01H 9/00* (2006.01)

(52) U.S. Cl.
USPC ..... 335/205; 200/564

(58) Field of Classification Search
USPC ..... 335/205–207; 200/404, 564
See application file for complete search history.

(56) References Cited

U.S. PATENT DOCUMENTS 4,942,394 A * 7/1990 Gasiunas ..... 340/870.31
5,546,067 A 8/1996 Schmidt et al.
6,028,502 A 2/2000 McSwiggen
6,154,201 A * 11/2000 Levin et al. ..... 345/184
6,560,029 B1 5/2003 Dobbie et al.
6,642,824 B2 * 11/2003 Oomkes ..... 335/207
7,297,889 B2 11/2007 Bornhorst et al.
2005/0067264 A1 3/2005 Kawamura
2006/0249362 A1 * 11/2006 Horton et al. ..... 200/296

OTHER PUBLICATIONS http://enwikipdeia.org/wiki/Rotary_encoder, Wikipedia Article : Rotary Encoder, Jul. 30, 2012.
Bianca Radisch, Authorized Officer of EPO, Partial International Search Report of PCT/US2013/034914, Annex to Form PCT/ISA/206; Jul. 5, 2013.

* cited by examiner

*Primary Examiner* — Bernard Rojas
(74) *Attorney, Agent, or Firm* — RatnerPrestia

(57) ABSTRACT

A rotary encoder switch assembly includes a panel having a hole that is defined at least partially through the panel, a recess that is formed along a circumference of the hole, and a bearing surface that is defined either on or adjacent the hole of the panel; a rotary encoder switch, which defines a bearing surface, that is mounted to the hole of the panel such that the encoder switch is configured to translate with respect to the panel, and rotate with respect to the panel until the bearing surface of the rotary encoder switch bears on the bearing surface of the panel; and a spring-loaded plunger that engages with the recess of the panel to provide tactile feedback to a user of the rotary encoder switch assembly when the spring-loaded plunger engages with the recess of the panel.

7 Claims, 6 Drawing Sheets

ROTARY ENCODER SWITCH WITH PULL FUNCTION TACTILE FEEDBACK AND POSITIVE STOP

FIELD OF THE INVENTION

This invention relates to a rotary encoder switch.

BACKGROUND OF THE INVENTION

A rotary encoder, also called a shaft encoder, is an electromechanical device that converts the angular position or motion of a shaft or axle to an analog or digital code. There are two main types of rotary encoders, i.e., absolute and incremental (relative). An incremental rotary encoder provides cyclical outputs when the encoder is rotated. Incremental rotary encoders may be either mechanical or optical. The mechanical type is typically used as a digital potentiometer on equipment including consumer devices. For example, most modern home and car stereos use mechanical rotary encoders for volume control. The incremental rotary encoder is the most widely used of all rotary encoders due to its low cost and ability to provide signals that can be easily interpreted to provide motion related information such as position, velocity and RPM. More information regarding incremental rotary encoders may be found, for example, on the Internet at Wikipedia.

SUMMARY OF THE INVENTION

According to one aspect of the invention, a rotary encoder switch assembly comprise a panel having a hole that is defined at least partially through the panel, a recess that is formed along a circumference of the hole, and a bearing surface that is defined either on or adjacent the hole of the panel; a rotary encoder switch, which defines a bearing surface, that is mounted to the hole of the panel such that the encoder switch is configured to translate with respect to the panel, and rotate with respect to the panel until the bearing surface of the rotary encoder switch bears on the bearing surface of the panel; and a spring-loaded plunger that engages with the recess of the panel to provide tactile feedback to a user of the rotary encoder switch assembly when the spring-loaded plunger engages with the recess of the panel.

According to another aspect of the invention, a sealing member is positioned between the rotary encoder switch and the hole of the panel to either limit or prevent the passage of fluid between the rotary encoder switch and the hole at the location of the sealing member.

According to yet another aspect of the invention, the rotary encoder switch assembly comprises a magnet connected to the rotary encoder switch; and an encoder chip that is positioned adjacent the magnet that is configured to sense rotational movement and/or translational movement of the magnet of the rotary encoder switch, wherein the encoder chip is not directly connected to the rotary encoder switch.

BRIEF DESCRIPTION OF THE DRAWING FIGURES

The invention is best understood from the following detailed description when read in connection with the accompanying drawing. Included in the drawing are the following figures.

DETAILED DESCRIPTION OF THE DRAWING FIGURES

Figure 1:
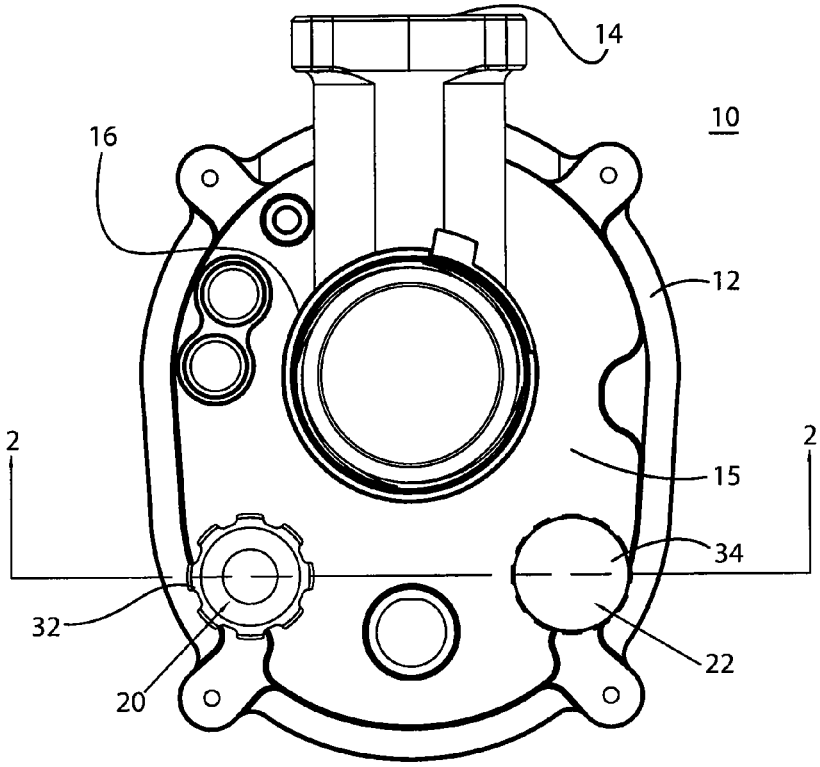
FIG. 1 depicts a front elevation view of a front panel assembly of a night vision optical device including two rotary encoder switches.

The invention is best understood from the following detailed description when read in connection with the accompanying drawing figures, which shows exemplary embodiments of the invention selected for illustrative purposes. The invention will be illustrated with reference to the figures. Such figures are intended to be illustrative rather than limiting and are included herewith to facilitate the explanation of the present invention. These drawings are not shown to scale.

Referring specifically to FIGS. 1-7, those figures depict the front panel assembly 10 of a night vision optical device. The remainder of the night vision optical device is not shown. However, the night vision device is disclosed in its entirety U.S. Pat. No. 6,560,029 to Dobbie et al., which is incorporated by reference herein in its entirety.

The front panel assembly 10 includes a front panel 12 defining a top surface 14 which is configured to be connected to a bracket (not shown) extending from a helmet (not shown) that is worn be a user of the night vision optical device, and a central bore 16 in which an optical lens (not shown) is positioned. In use, the top surface 14 of the front panel 12 is indirectly connected to the bracket (not shown) and the optical lens (not shown) in the central bore 16 is positioned before the eye of the user of the night vision optical device.

The front panel 12 is optionally die cast and formed from a metallic material. The front panel 12 includes an interior facing surface 13 that faces the interior region of the optical device and an exterior facing surface 15 that faces the helmet that is worn by the user of the optical device.

Figure 2:
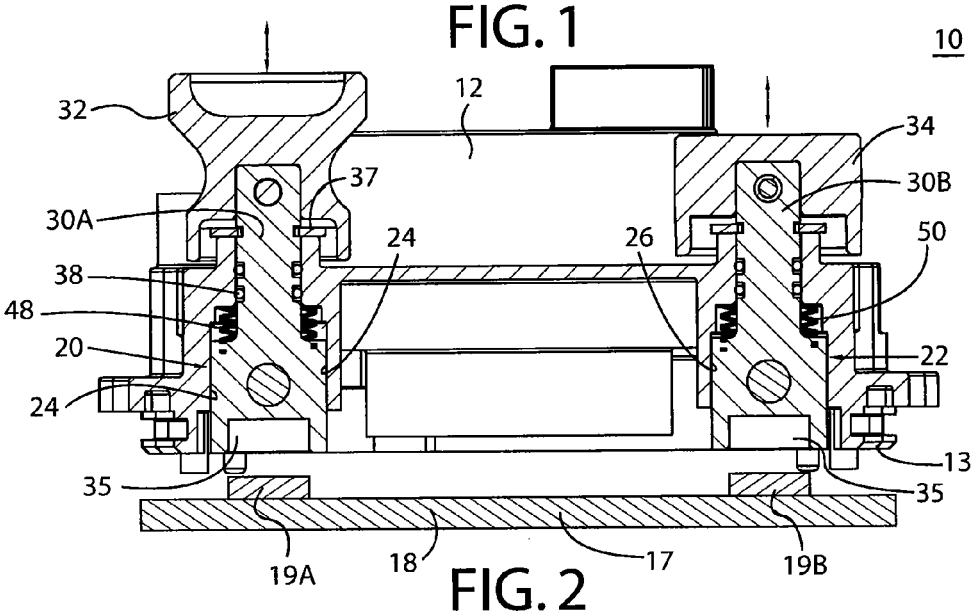
FIG. 2 depicts a cross-sectional side view of the front panel assembly of FIG. 1 taken along the lines 2-2 that is positioned adjacent a circuit board assembly of the night vision optical device (the circuit board assembly is only shown in FIG. 2).

As shown in FIG. 2, a circuit board assembly 17 is mounted either directly or indirectly to the interior facing surface 13 of the front panel 12. The circuit board assembly 17 generally includes two magnets 19A and 19B that are mounted to a printed circuit board 18. The circuit board assembly 17 may be considered as forming part of the front panel assembly 10 or it may be considered as being a separate component of the optical device. The circuit board assembly 17 is only shown in FIG. 2.

Referring now to FIGS. 2 and 6-10, the front panel assembly 10 also includes two rotary encoder switches 20 and 22 that are mounted through holes 24 and 26 (see FIGS. 6 and 7), respectively, of the front panel 12. The assembly of the front panel 10 and the switches 20 and 22 may also be referred to herein as an encoder switch assembly.

The rotary encoder switches 20 and 22 are each capable of rotation and translation with respect to the front panel 12, as will be described in greater detail hereinafter. The rotary encoder switch 20 includes a switch sub-assembly 30A and a knob 32 that is mounted to the switch sub-assembly 30A. Similarly, the other rotary encoder switch 22 includes a switch sub-assembly 30B and a knob 34 that is mounted to the switch sub-assembly 30B. The switch sub-assemblies 30A and 30B are structurally and functionally equivalent.

The features of rotary encoder switch 20 and the hole 24 of the front panel 12 in which the switch 20 is mounted will be described hereinafter, however, it should be understood that the following description applies equally to the other rotary encoder switch 22 and the hole 26 in which the switch 22 is mounted.

Figure 10:
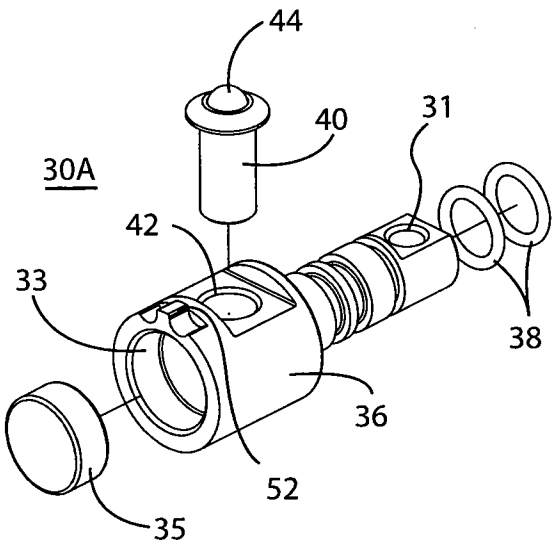
FIG. 10 is a rear perspective view of the rotary encoder switch sub-assembly of FIG. 8 shown exploded.
Figure 9:
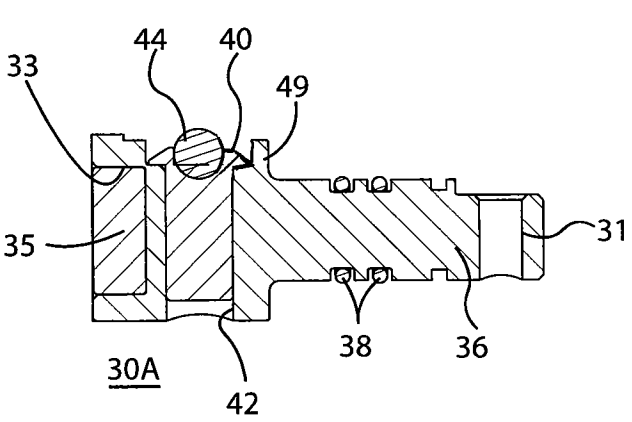
FIG. 9 depicts a cross-sectional side view of the rotary encoder switch sub-assembly of FIG. 8 taken along the lines 9-9.
Figure 8:
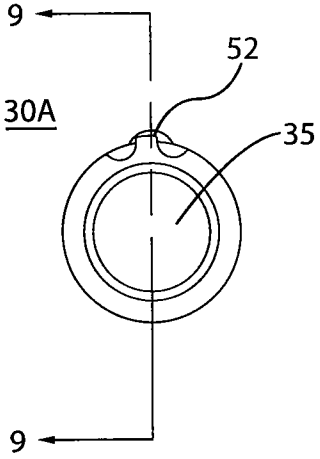
FIG. 8 is a rear elevation view of a rotary encoder switch sub-assembly.

As best shown in FIGS. 8-10, the switch sub-assembly 30A of the rotary encoder switch 20 includes a cylindrical shaft 36. The shaft 36 is optionally composed of a metallic material. A hole 31 is formed on one end of the shaft 36. The longitudinal axis of the hole 31 is substantially perpendicular to the longitudinal axis of the shaft 36. In an assembled form of the front panel assembly 10, a captive fastener on the knob 32 is positioned at least partially through the hole 31 in order to mount the knob 32 to the shaft 36.

A cylindrical recess 33 is formed on the opposite end of the shaft 36. A magnet 35 is fixedly mounted in the recess 33 such that the magnet 35 rotates along with the shaft 36 of the encoder switch. As best shown in FIG. 2, in an assembled form of the front panel assembly 10, the magnet 35 of the switch sub-assembly 30A is positioned adjacent an encoder chip 19A of the circuit board assembly 17. The encoder chip 19A senses the rotational and translational position of the magnet 35 of the encoder switch 20.

Unlike some conventional rotary encoder switches, the encoder chip 19A is not directly connected to the rotary encoder switch 20. Thus, if the switch 20 were to fail for any reason, removal and replacement of the expensive encoder chip 19A would be unnecessary.

The interaction between the encoder chip 19A and the magnet 35 should be understood by those of ordinary skill in the art of rotary encoders. Also, it should be understood that the magnet 35 of the switch sub-assembly 30B of the other rotary encoder switch 22 is positioned adjacent an encoder chip 19B of the circuit board assembly 17, and operates in the same fashion.

A series of O-rings 38 are positioned in annular grooves that are formed in a central region of the shaft 36. As best shown in FIG. 2, the O-rings 38 bear on the inner surface of the hole 24 in the front panel 12 to prevent the ingress of liquid or other contaminants through the hole 24 and into the interior of the optical device. It follows that the optical device may be designed such that it is submersible in water. The O-rings may also be referred to herein as sealing members.

Referring now to FIGS. 4A and 8-10, a hole 42 is formed in the shaft 36 at a location between the hole 33 and the annular grooves for the O-rings 38. The longitudinal axis of the hole 42 is substantially perpendicular to the longitudinal axis of the shaft 36. In an assembled form of the rotary encoder switch 20, a spring-loaded plunger 40 is fixedly positioned at least partially through the hole 42. The spring-loaded plunger 40 rotates along with the shaft 36. The spring-loaded plunger 40 includes a spring-loaded bearing 44 that protrudes from the side of the switch sub-assembly 30A. The purpose of the plunger 40 will be described later with reference to FIG. 4A.

Figure 7:
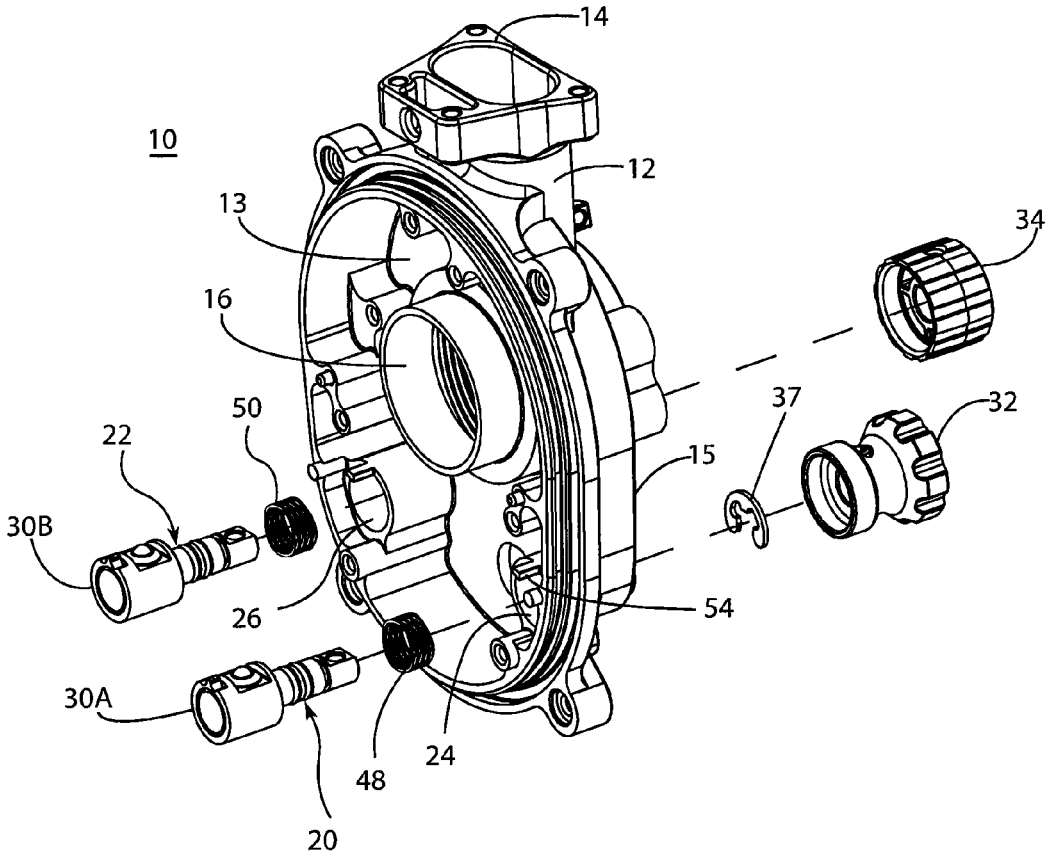
FIG. 7 is a rear perspective view of the front panel assembly of FIG. 1 shown exploded.

Referring now to FIGS. 2, 7 and 9, the switch 20 is capable of translating in the hole 24 of the front panel 12 in a limited range. More particularly, a coiled spring 48 is positioned between a shoulder defined in the hole 24 in the front panel 12 and a shoulder 49 (see FIG. 9) defined on the shaft 36 of the rotary encoder switch 20. As best shown in FIG. 2, the spring 48 biases the rotary encoder switch 20 and its magnet 35 toward the encoder chip 19A of the circuit board assembly 17. A coiled spring 50 is associated with the other rotary encoder switch 22, and performs the same function as spring 48.

A snap ring 37 is coupled to the end of the shaft 36 of the rotary encoder switch 20. As best shown in FIG. 2, the snap ring 37 bears on a surface of the front panel 12 to retain the spring 48 in a state of compression and limit the amount of bias that is applied to the rotary encoder switch 20 by the spring 48. The snap ring 37 also prevents the end of the switch 20 from contacting the encoder chip 19A.

In operation, a user pulls the knob 32 of the encoder switch 20 away from the front panel 12 as indicated by the arrows in FIG. 2 against the force of the spring 48. Translating the knob 32 away from the front panel 12 causes the magnet 35 to separate further from the encoder chip 19A. The encoder chip 19A senses the reduction in the magnetic field and communicates this event to a processor of the optical device (not shown). Upon receiving this communication, the processor of the optical device is configured to perform a pre-determined function, such as activating or deactivating a channel of the optical device. For example, upon pulling the knob 32, the processor of the optical device is configured to activate the Infrared channel of the optical device.

Figure 5A:
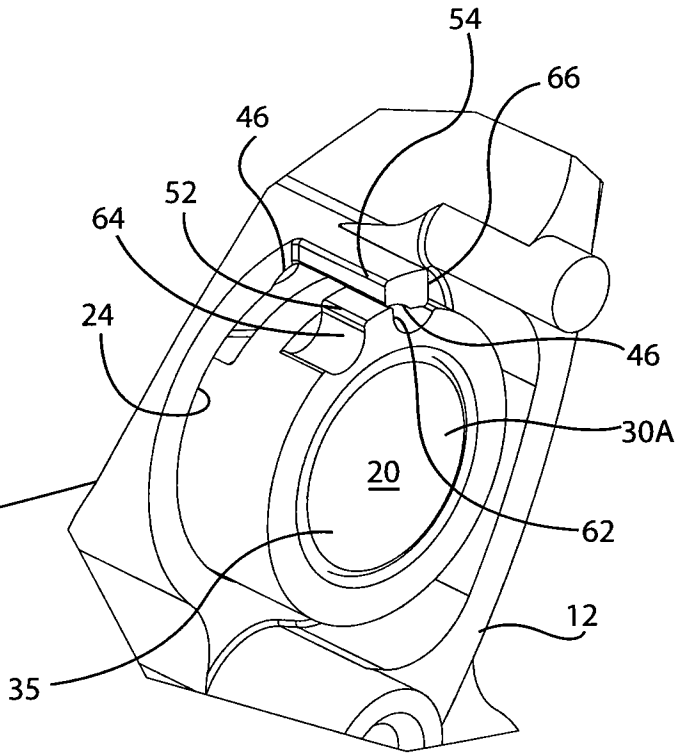
FIG. 5A is a detailed view of the front panel assembly of FIG. 5.
Figure 5:
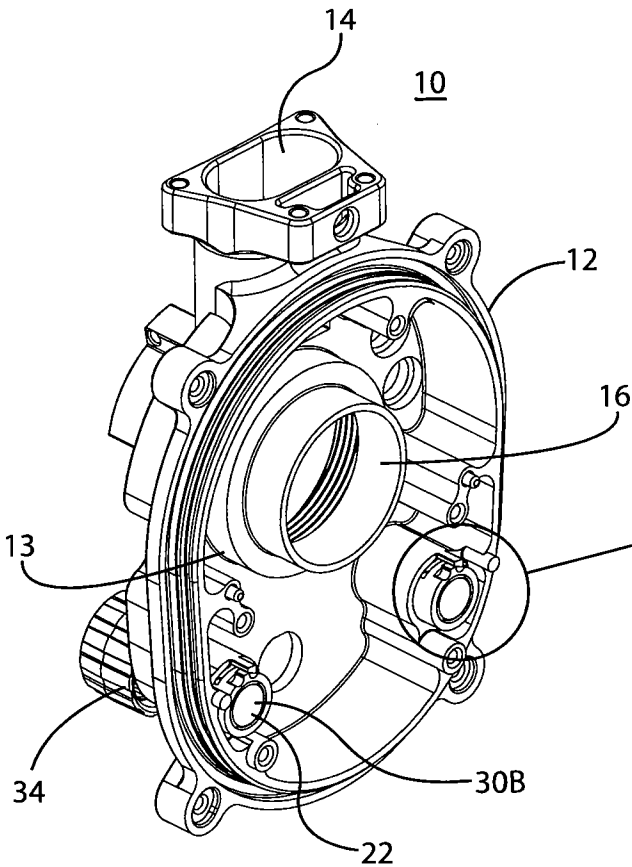
FIG. 5 is a rear perspective view of the front panel assembly of FIG. 1.
Figure 6:
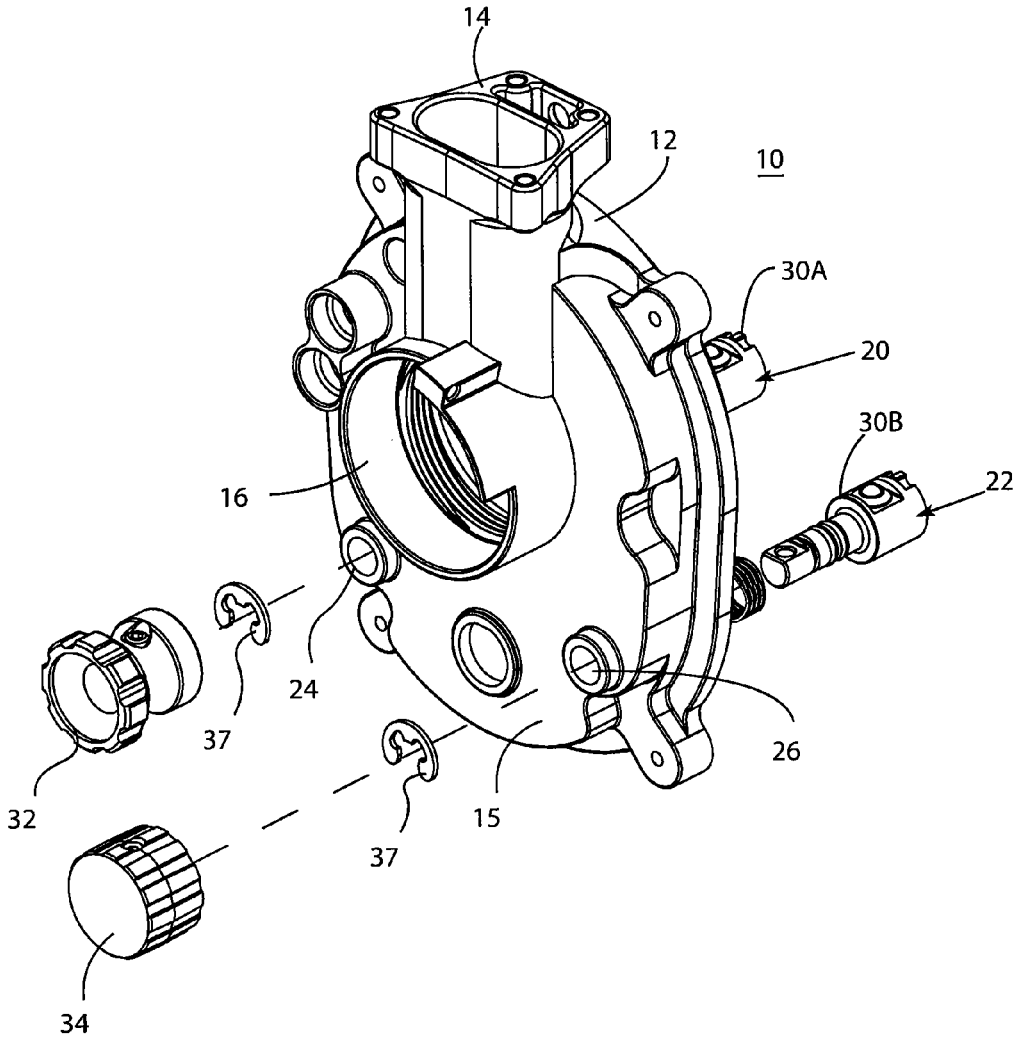
FIG. 6 is a front perspective view of the front panel assembly of FIG. 1 shown exploded.

Referring now to FIGS. 5A, 7 and 10, the switch 20 is also capable of rotating in the hole 24 in a limited range of rotation in both clockwise and counterclockwise directions between two terminal positions. The terminal positions may represent ON, OFF or maximum rotation positions for a particular channel of the night vision device.

Figure 4A:
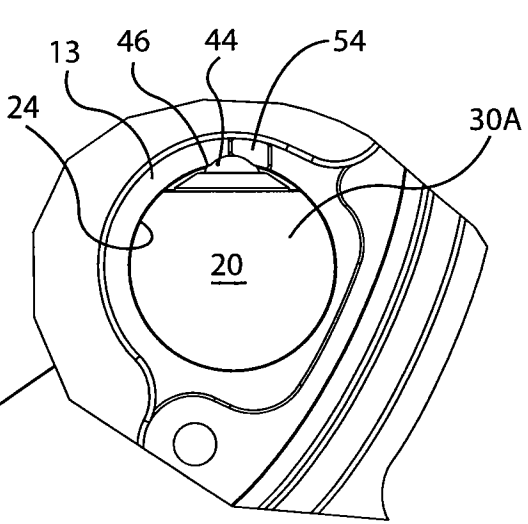
FIG. 4A is a detailed view of the front panel assembly of FIG. 4.
Figure 4:
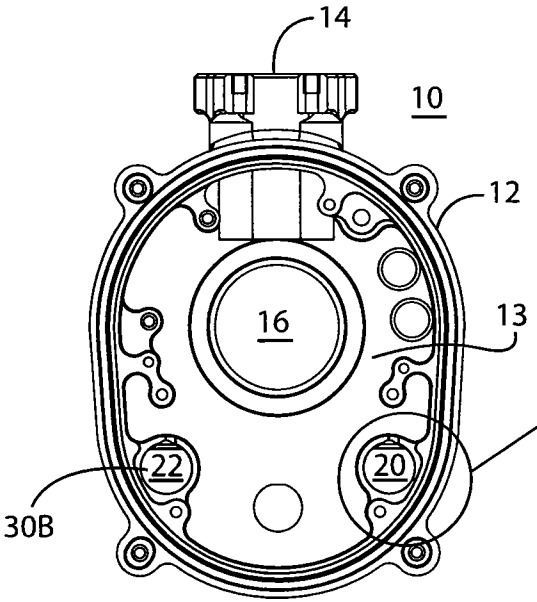
FIG. 4 depicts a cross-sectional side view of the front panel assembly of FIG. 3 taken along the lines 4-4.
Figure 3:
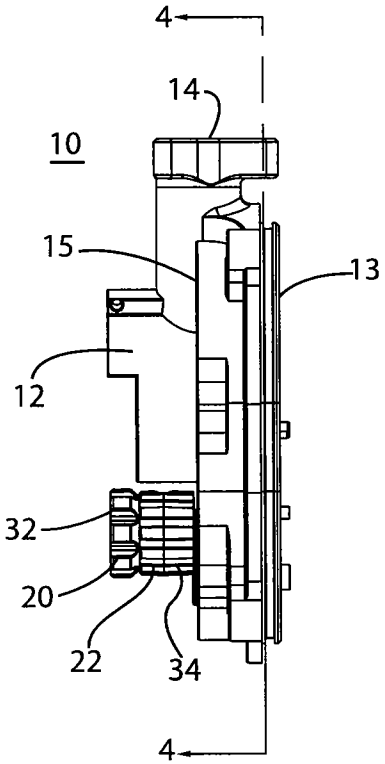
FIG. 3 depicts a right side elevation view of the front panel assembly of FIG. 1.

In a first terminal position of the encoder switch 20, which is shown in FIGS. 4A and 5A, a bearing surface 62 on a protrusion 52 of the switch 20 contacts a crescent-shaped recess 46 that is formed on a stop 54 of the front panel 12. As best shown in FIGS. 4A and 5A, the crescent-shaped recess 46 is formed along the length of the hole 24 of the front panel 12 and the stop 54. The stop 54 protrudes from the interior facing surface 13 and is positioned adjacent the hole 24 that is formed in the front panel 12. Once the encoder switch 20 is rotated to the first terminal position, the switch 20 can not be rotated in the same direction any further because the bearing surface 62 bears on the recess 46.

In a second terminal position of the encoder switch 20, which is not shown, a bearing surface 64 of the switch 20 contacts a bearing surface 66 of the stop 54 of the front panel 12. Once the encoder switch 20 is rotated to the second terminal position, the switch 20 can not be rotated in the same direction any further because the bearing surface 64 bears on the bearing surface 66.

Referring now to FIG. 4A, the rotary switch 20 is capable of providing tactile feedback to a user either upon reaching or shortly before reaching the first terminal position of the switch 20 that is shown in FIGS. 4A and 5A. More particularly, very shortly before reaching the first terminal position, the spring-loaded bearing 44 of the rotary encoder switch 20 springs outward to engage the crescent-shaped recess 46 that is formed in the hole 24. Engagement between the spring-loaded bearing 44 and the crescent-shaped recess 46 provides the user with tactile feedback to alert the user that the rotary encoder switch 20 has reached the first terminal position. The spring action of the bearing 44 may be audible or inaudible. Rotating the switch 20 further towards the first terminal position causes the bearing surface 62 of the switch 20 to bear on the recess 46 of the front panel 12.

It should be understood that the spring-loaded bearing 44 of the rotary encoder switch 20 does not engage with any recess of the hole 24 in the second terminal position of the switch. However, another recess may be added to the hole 24 at the second terminal position.

Rotating the encoder switch 20 in the opposite direction, i.e., from the first terminal position toward the second terminal position, causes the spring-loaded bearing 44 of the rotary encoder switch 20 to move backward against its own spring force toward the shaft 36 of the switch 20 and disengage from the crescent-shaped recess 46 of the hole 24. The tactile feedback provided by the bearing 44 alerts the user that the rotary encoder switch 20 has moved out of the first terminal position.

In operation, a user rotates the knob 32 of the encoder switch 20 between the first and second terminal positions to either activate or deactivate the optical device or a function of the optical device, or to adjust some setting of the optical device. More particularly, rotating the knob 32 causes the magnet 35 of the switch 20 to rotate with respect to the encoder chip 19A that is fixed in place. The encoder chip 19A senses the rotational movement of the magnet 35 of the encoder switch 20. The encoder chip 19A is configured to communicate this event to a processor of the optical device (not shown). Upon receiving this communication, the processor of the optical device is configured to perform a predetermined function, e.g., activating a channel, deactivating a channel, or changing the setting of a channel such as the brightness or gain.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

What is claimed:

1. A rotary encoder switch assembly comprising:

a panel including a hole defined at least partially through the panel, a rotary encoder switch mounted into the hole of the panel and the encoder switch translatable with respect to the panel, and rotatable with respect to the panel;

the rotary encoder switch oriented in a longitudinal dimension and transversely to the panel, a first stop protruding from the panel in the longitudinal dimension having first and second longitudinal bearing surfaces, a single crescent-shaped recess formed along the longitudinal dimension of the stop and extending longitudinally into a length of the hole, and the crescent-shaped recess defining the first bearing surfaces, a spring-loaded plunger that engages with the crescent-shaped recess of the panel to provide tactile feedback to a user when the spring-loaded plunger engages the crescent-shaped recess;

a spring oriented in the longitudinal dimension and positioned between the rotary encoder switch and the panel to bias the rotary encoder switch toward the panel;

wherein the rotary encoder switch is translatable in the longitudinal dimension in a direction away from the panel against a force of said spring;

the rotary encoder switch including a second stop having third and fourth longitudinal bearing surfaces;

wherein when the rotary encoder switch is rotated in a clock-wise direction, the third bearing surface abuts the crescent-shaped recess defining the first bearing surface; and when the rotary encoder switch is rotated in a counter clock-wise direction, the fourth bearing surface abuts the second bearing surface; and wherein a magnet is connected to the rotary encoder switch and an encoder chip that is positioned adjacent the magnet senses rotational movement and translational movement of the magnet of the rotary encoder switch; and a first switch position is sensed by the encoder chip when the third bearing surface abuts the first bearing surface;

a second switch position is sensed by the encoder chip when the fourth bearing surface abuts the second bearing surface; and rotation of the rotary encoder switch alerts the user that the rotary encoder switch has moved out of the first switch position; and an ON/OFF switch position is sensed by the encoder chip when the rotary encoder switch is translated in the longitudinal direction away from the panel.

2. The rotary encoder switch assembly of claim 1 further comprising a lens bore defined in the panel includes an optical lens.

3. The rotary encoder switch assembly of claim 1 further comprising a sealing member positioned between the rotary encoder switch and the hole of the panel to prevent the passage of fluid between the rotary encoder switch and the hole at the location of the sealing member.

4. The rotary encoder switch assembly of claim 1, wherein the encoder chip is not directly connected to the rotary encoder switch.

5. The rotary encoder switch assembly of claim 1 further comprising another hole formed in the panel, and another rotary encoder switch that is mounted to said other hole of the panel.

6. A rotary encoder switch assembly comprising:

a panel including a hole defined at least partially through the panel and a crescent-shaped recess formed along a circumference of the hole and a length of the hole;

a rotary encoder switch that is mounted to the hole of the panel such that the encoder switch rotates and translates with respect to the panel wherein rotation is along the circumference of the hole and translation is along the length of the hole;

a sealing member positioned between the rotary encoder switch and the hole of the panel to prevent passage of fluid between the rotary encoder switch and the hole at the location of the sealing member;

a spring positioned between the rotary encoder switch and the panel to bias the rotary encoder switch toward the panel, wherein the rotary encoder switch is translated by a user along the length of the hole in a direction away from the panel against a force of said spring;

a magnet connected to the rotary encoder switch and an encoder chip positioned adjacent the magnet for sensing rotational movement and translational movement of the magnet of the rotary encoder switch; and the translation by the user is decoded as an ON/OFF setting of the assembly.

7. The rotary encoder switch assembly of claim 6, wherein the encoder chip is not directly connected to the rotary encoder switch.

* * * * *